United States Patent [19]

Okabe

[11] Patent Number: 4,793,132

[45] Date of Patent: Dec. 27, 1988

[54] APPARATUS FOR COOLING STEAM TURBINE FOR USE IN SINGLE-SHAFT COMBINED PLANT

[75] Inventor: Akira Okabe, Hitachi, Japan

[73] Assignee: Hitachi, Ltd., Tokyo, Japan

[21] Appl. No.: 42,252

[22] Filed: Apr. 24, 1987

[30] Foreign Application Priority Data

Apr. 25, 1986 [JP] Japan ..... 61-94846

[51] Int. Cl.[4] ..... F02C 6/18

[52] U.S. Cl. ..... 60/39.182; 122/7 R

[58] Field of Search ..... 60/39.141, 39.181, 39.182, 60/39.3; 122/7 R, 7 B

[56] References Cited

U.S. PATENT DOCUMENTS 3,204,407 9/1965 Meissenberg et al. ..... 60/39.182
4,081,956 4/1978 Baker et al. ..... 60/39.182
4,207,842 6/1980 Kehlhofer ..... 60/39.182
4,501,233 2/1985 Kusaka ..... 122/7 R
4,519,207 5/1985 Okabe et al. ..... 60/39.182

*Primary Examiner*—Louis J. Casaregola
*Attorney, Agent, or Firm*—Antonelli, Terry & Wands

[57] ABSTRACT

A combined plant comprising a gas turbine, a waste heat recovery boiler using exhaust gases of the gas turbine as a heat source and including low pressure and high pressure steam generators and a steam turbine arranged to be driven by the steam supplied from the boiler, the gas turbine and the steam turbine being connected by a single shaft. At the time of plant startup, low pressure steam from the low pressure steam generator is introduced into the steam turbine prior to the generation of high pressure steam, thereby preventing the steam turbine from being overheated due to a windage loss.

2 Claims, 2 Drawing Sheets

APPARATUS FOR COOLING STEAM TURBINE FOR USE IN SINGLE-SHAFT COMBINED PLANT

BACKGROUND OF THE INVENTION

The present invention relates generally to a combined plant including a steam turbine and a gas turbine connected together by a single shaft, the steam turbine being driven by the steam generated by using the waste heat from the gas turbine as a heat source, and more particularly to an apparatus for and a method of effecting cooling so as to prevent overheating of the steam turbine at the time of plant startup.

In this type of single-shaft combined plant, the steam turbine and gas turbine can be started and accelerated at the same time. Thus, this type of plant offers the advantage that it is possible to shorten the time required for achieving startup as compared with a multiple-shaft type combined plant in which the steam turbine and gas turbine have separate shafts.

However, in this type of single-shaft combined plant, feeding of steam to the steam turbine is not obtainable until the gas turbine is first accelerated and its exhaust gases are led to a waste heat recovery boiler to generate steam by using the exhaust gases as a heat source. As the consequence, the steam turbine may be overheated by a windage loss (loss of power provided by the agitation of gases within the steam turbine) until steam is fed to the steam turbine. Although the steam turbine is arranged to have its inner pressure reduced with a vacuum pump for a condenser, the inner pressure substantially approximates the atmospheric pressure at the time of plant startup. In addition, in order to maintain the condenser in vacuum, the gland sealing portion of the condenser is supplied with sealing steam having a high temperature of about 300° C., and the sealing steam flows through the gland sealing portion into the steam turbine. In particular, this steam remarkably heats the low pressure final stage of the turbine or stages near it. Moreover, since the turbine has elongated rotor blades at the final stage and stages near it, centrifugal stresses developing at the roots of the blades are higher at the final stage and stages near it than at an initial stage of the turbine. For this reason, if the temperature in this part of the turbine shows a marked rise in temperature, the material would undesirably be greatly reduced in strength.

To cope with the aforesaid problem, a known method is proposed, for example, in U.S. Pat. No. 4,519,207. In this prior method, an ancillary steam source is provided for the purposes of a cooling operation, and the cooling steam generated by the ancillary steam source is introduced into the low pressure final stages or similar stages of the steam turbine, thereby preventing overheating thereof.

The above-described method according to the prior art, however, suffers from the problem of causing an increase in plant construction costs incurred by the addition of the ancillary steam source and associated systems. Furthermore, since it is necessary to supply ancillary steam through a line independent of the single combined shaft system, there is a problem in that it is impossible to perform "black start" of the single combined shaft system alone.

SUMMARY OF THE INVENTION

It is therefore an object of the present invention to provide a method of effecting cooling and a cooling apparatus suitable for carrying out the cooling method both of which enables prevention of overheating of the steam turbine as might be caused by a windage loss within the turbine while the steam turbine is being operated under no load condition at the time of plant startup and without the need to introduce any ancillary steam through any line other than the single shaft system.

The above-described object is achieved by introducing cooling steam by opening a lower pressure control valve prior to the opening of a high pressure control valve when the windage loss near the low pressure final stage has been increased due to the rise in the rotational speed of the single combined shaft. (According to the prior art, after the high pressure control valve has been opened, the low pressure control valve is opened.) Specifically, establishment of conditions for opening the low pressure control valve requires (a) the fact that a specified value is reached by the rotational speed of the single shaft as an index of the windage loss and (b) the fact that the level of low steam pressure reaches a specified value. A control device is disposed to supply an opening signal to the low pressure control valve under the condition that these requirements (a) and (b) are satisfied.

DETAILED DESCRIPTION ON THE INVENTION

Figure 1:
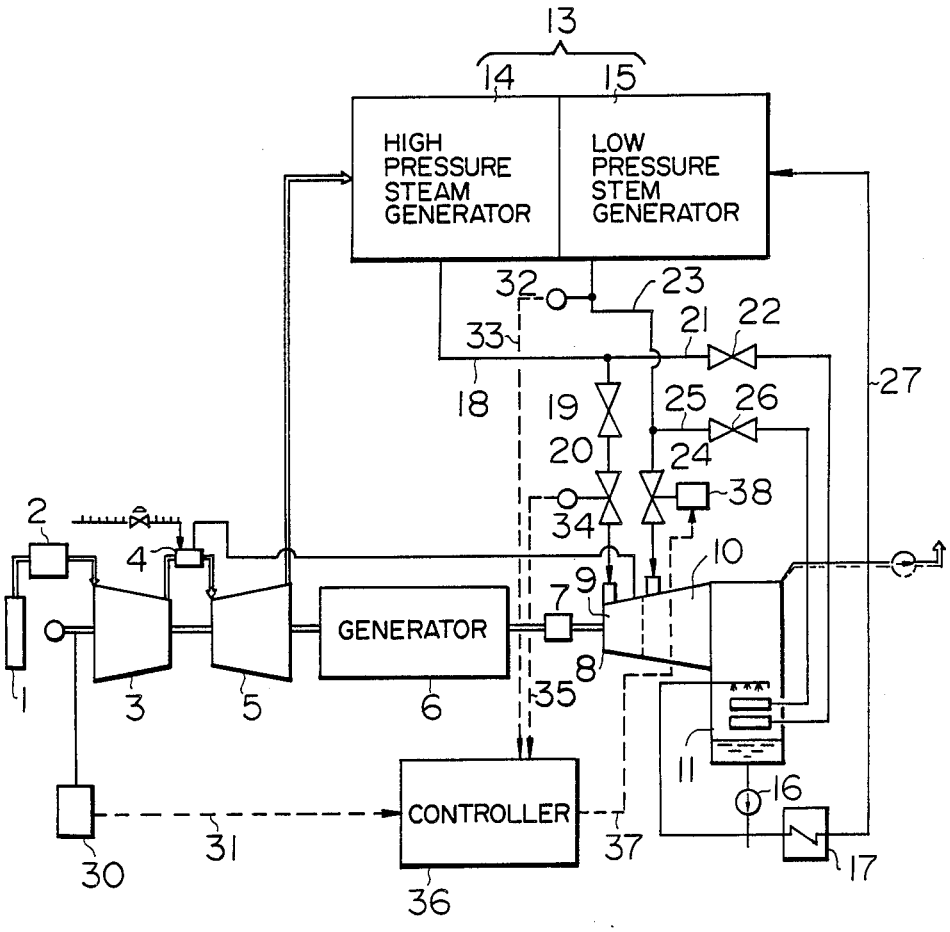
FIG. 1 is a system chart of an example of a single-shaft type combined plant including a preferred embodiment of a cooling apparatus in accordance with the present invention.

In general, the level of the windage loss produced within a steam turbine is substantially proportional to the cube of the rotational speed of the turbine. Thus, as such a rotational speed rises, the level of windage loss increases with increasing speed. Accordingly, the timing at which cooling is needed can be detected on the basis of the rotational speed.

The manner of startup is typically classified into "hot start" and "cold start", the hot start featuring a short period of downtime as between the stoppage of the turbine and the restart thereof while the cold start defining a case where the temperature of the turbine metal is lowered owing to a prolonged downtime of the turbine. Heat generated during a starting operation under non-load conditions becomes a problem in the case of the former hot start in which high-temperature sealing steam easily flows into the turbine and the temperature of the metal is still high. In the case of hot start, since a waste heat recovery boiler generally has a large quantity of residual heat, steam of low temperature and pressure is normally generated while the gas turbine is being accelerated after the startup of the same. The low pressure control valve has heretofore been opened after completion of opening of the high pressure control valve. However, in accordance with the present invention, even if a certain amount of low pressure steam is generated and the steam pressure rises to a predetermined level, the low pressure control valve is opened prior to the accomplishment of high pressure conditions.

In the method of this invention, at the time of plant startup, cooling steam is introduced into the low pressure steam turbine by opening the low pressure steam control valve prior to the opening of the high pressure control valve under the following conditions:

(a) the rotational speed of the aforesaid single shaft reaches a predetermined value; and (b) the pressure level of low pressure steam acting to drive the aforesaid steam turbine reaches a predetermined value.

The apparatus of this invention is devised in order to readily carry out the above-described method and enable satisfactory realization of the advantages, the apparatus comprising:

(a) at least one sensor for detecting the fact that the rotational speed of the single shaft reaches a predetermined value;

(b) at least one sensor for detecting the fact that the pressure of the low pressure steam acting to drive the aforesaid steam turbine reaches a predetermined value; and (c) at least one control device arranged to output a signal for opening and closing the low pressure steam control valve in response to a signal output from the sensors set forth in items (a) and (b) and an input signal representative of the opened and closed states of the high pressure steam control valve.

Utilization of the aforesaid cooling method enables steam of low temperature and pressure to be introduced into the steam turbine without involving the risk of adversely affecting the apparatus, thereby preventing the occurrence of a windage loss and overheating of the steam turbine.

A preferred embodiment of the present invention will be described below in detail with reference to the accompanying drawings.

FIG. 1 shows an example of a single-shaft combined plant provided with a cooling device constructed so as to carry out the method of this invention. The combined plant shown in FIG. 1 comprises an air compressor 3, a gas turbine 5 and a generator 6 constituting a gas turbine device which is connected to a steam turbine 8 by a single shaft through a coupling 7. Air is led though an air inlet 1 and a silencer 2 into the air compressor 3 where it is compressed and mixed with a fuel gas in a combustor 4 and burned therein to produce a gas of high temperature and pressure. After the thus obtained gas has done work at the gas turbine 5, exhaust gases flow as a heating fluid into a steam generator assembly (or waste heat recovery boiler) indicated collectively at 13. The steam generator assembly 13 includes a high pressure steam generator 14 and a low pressure steam generator 15. The steam produced by the high pressure steam generator 14 is led through a high pressure steam line 18 via a high pressure steam stop valve 19 and a high pressure steam control valve 20 into a high pressure turbine 9. The steam is adapted to flow through a high pressure bypass line 21 and a high pressure bypass valve 22 into a condenser 11 until high pressure conditions are established during plant startup. The low pressure steam generator 15 produces low pressure steam which flows through a low pressure steam line 23 via a low pressure steam control valve 24 into a low pressure turbine 10. The steam exhausted from the steam turbine 8 is converted into a condensate at the condenser 11, flowing through a condensate pump 16 and a gland sealing portion 17, returning through a feedwater line 27 to the steam generator assembly 13. The steam flows to the condenser 11 through a low pressure bypass line 25 branching from the low pressure steam line 23 via a low pressure bypass valve 26 disposed in the bypass line 25 as is the case with the steam flowing to the condenser 11 via the high pressure bypass valve 22.

A pickup 30 is disposed to detect the rotational speed of the single combined shaft, generating a signal 31 representative of the rotational speed thus detected. A pressure sensor 32 is disposed to detect the pressure level of low pressure steam, generating a signal 33. The state of opening of the high pressure steam control valve 20 is detected by a travel indicator 34, and is converted into a signal 35 representative of the opening. The respective signals 31, 33 and 35 representative of the rotational speed, the pressure of low pressure steam and the opening of the high pressure control valve are input to a control device 36. In response to the input, a signal 37 for opening and closing the low pressure steam control valve is delivered from the control device 36 to the input of an actuator 38 which is arranged to open and close the low pressure steam valve 24.

Figure 2:
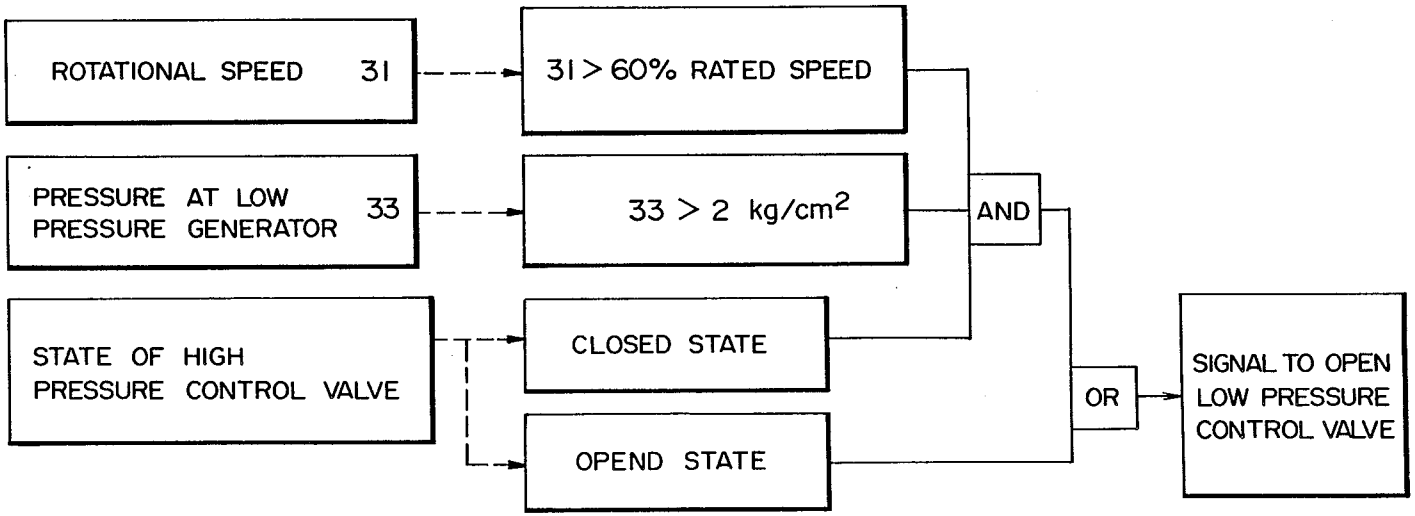
FIG. 2 is a block diagram of the construction of a control device for controlling the low pressure control valve for use with the preferred embodiment shown in FIG. 1.

FIG. 2 is a block diagram of the construction of the control device 36 for controlling opening and closing of the low pressure control valve 24 shown in FIG. 1. In FIG. 2, the condition of the rotational speed of the single shaft is selected to be equal to or greater than 60% of its rated speed of rotation. In order to ensure the amount of the steam produced by the low pressure generator 15 forming a part of the steam generator 13 (waste heat recovery boiler), the pressure condition of low pressure steam is established to prevent the low pressure control valve 24 from being opened in a state where the pressure of the low pressure steam is extremely low. This is because, if the low pressure control valve 24 is opened in a state where the pressure of the low pressure steam has not yet reached a sufficient level, the low pressure steam generator 15 is liable to be tripped. The opened and closed states of the high pressure control valve are detected for the purpose of ensuring supply of low pressure steam even in a state where no high pressure steam is produced. In general, a conventional arrangement is such that the low pressure stream control valve is opened ony under the condition that the high pressure control valve is open. However, the present invention is arranged in such a manner that the low pressure steam control valve is capable of being opened prior to the opening of the high pressure steam control valve f the conditions for the rotational speed of the single shaft and the pressure of low pressure steam are fulfilled. As a matter of course, if the period taken until the rotational speed reaches to a predetermined level and the period taken until the pressure of low pressure steam rises to a certain level can be anticipated prior to plant startup, the control device is capable of being arranged to cause opening of the low pressure control valve after a predetermined period of time has elapsed.

From the detailed description above, it will be appreciated that adaptation of the cooling method in accordance with the present invention enables the low pressure valve to be opened for the purpose of ensuring supply of cooling steam during the startup of the single-shaft combined plant. This provides the superior effect of preventing the steam turbine from being overheated due to a windage loss.

In addition, utilization of the cooling apparatus in accordance with the present invention enables easy performance of the aforesaid cooling method, thereby properly effecting the advantages of this method.

What is claimed is:

1. For use in a single-shaft combined plant including a gas turbine, a steam generator using exhaust gases of said gas turbine as a heat source and including a low pressure steam generator and a high pressure steam generator, and a steam turbine driven by the steam supplied from the steam generator, said steam turbine and said gas turbine being connected together by a single shaft, an apparatus for cooling said steam turbine comprises:

(a) sensor means for sensing that the rotational speed of said single shaft reaches a predetermined value;

(b) sensor means for sensing that the pressure level of low pressure steam acting to drive said steam turbine reaches a predetermined value; and (c) control means for outputting a signal to open and close a low pressure steam control valve in response to the signals from said sensor means set forth in items (a) and (b).

2. A cooling apparatus adapted for use in a single-shaft combined plant according to claim 1, wherein said control means further receive a signal corresponding to the opened or closed state of said high pressure steam control valve.

* * * * *